United States Patent [19]

Berger

[11] 4,045,004

[45] Aug. 30, 1977

[54] CHEMICAL MIXING AND PUMPING APPARATUS

[76] Inventor: Henry F. Berger, 402 N17, Springfield, Oreg. 97477

[21] Appl. No.: 728,509

[22] Filed: Oct. 1, 1976

[51] Int. Cl.[2] ..... B01F 15/00

[52] U.S. Cl. ..... 259/4 R; 137/239; 222/88

[58] Field of Search ..... 259/4 R, 18, 36, 40; 222/81, 88; 137/239, 563

[56] References Cited

U.S. PATENT DOCUMENTS

| | | | |
|---|---|---|---|
| 1,544,922 | 7/1925 | Midgley | 222/88 |
| 2,636,653 | 4/1953 | Stams | 137/239 X |
| 3,345,997 | 10/1967 | Miller | 259/18 X |
| 3,661,364 | 5/1972 | Lage | 259/4 R |

*Primary Examiner*—Edward J. McCarthy

*Attorney, Agent, or Firm*—Kolisch, Hartwell, Dickinson & Stuart

[57] ABSTRACT

Apparatus for commingling liquid chemicals includes a mixing tank having a drain valve and a liquid container impaling head for piercing a container impressed thereon so that the container's liquid chemical contents will flow into the tank. A pump is operatively connected to the tank for transporting liquid such as water from an external supply into the tank. The pump is also operable for continuously recirculating liquid from the tank and back thereinto so as to commingle the liquid from the supply and the container. The pump's inlet is also connected to a second liquid supply so that liquid from a barrel or drum may be withdrawn therefrom and mixed in the tank. An extendible-contractible member is slidably arranged within a conduit to permit the contents of the barrel or drum to be substantially evacuated.

14 Claims, 3 Drawing Figures

CHEMICAL MIXING AND PUMPING APPARATUS

BACKGROUND OF THE INVENTION

The present invention relates to apparatus and method for mixing and dispensing chemicals, and more particularly to such apparatus and method for recirculating chemicals into a mixing tank by a circulating pump. Chemicals from different sized containers may be readily commingled and the resultant mixture transported by means of the pump to an end use.

In certain chemical mixing applications, it is desirable to commingle chemicals with water and transport the resultant mixture to an end use. For instance, agricultural spray aircraft utilize tanks which are filled with a water-chemical pesticide or fertilizing mixture. The chemicals to be mixed for use in spray aircraft are initially contained in various sized containers.

A problem resides in adequately mixing such chemicals with water or other liquid without permitting escape of the chemicals to the environment. Heretofore, relatively large mixing tanks have been utilized for mixing chemicals and water. The chemicals are poured or otherwise dispensed from their respective containers into the mixing tank with resulting diffusion of some of the chemicals into the surrounding atmosphere. Furthermore, there is always present a certain amount of chemical residue within chemical containers after the bulk of the contents have been poured from the containers.

Chemical mixing apparatus of various types have been proposed in the prior art, but such apparatus do not provide a system in which a small container may be readily opened and rinsed so that its contents are quickly and completely dispensed into a mixing tank. Furthermore, the prior art does not provide for a chemical mixing system which is adaptable for mixing chemicals from larger containers and then rinsing the containers so as to prevent pollution to the environment.

Additionally, the prior art does not provide for a closed chemical mixing system which may be selectively operated so as to dispense chemicals from different containers into a mixing tank and then transport the resultant mixture.

SUMMARY OF THE INVENTION

The present invention provides an apparatus and method for commingling chemicals, or chemicals with water, and includes a reservoir or mixing tank which permits recirculation of chemicals therefrom through a pump and back into the tank. After sufficient mixing of the chemicals has taken place through recirculation, the pump is operable to discharge the mixture to an end use such as an agricultural spray aircraft. The mixing tank is provided with an impaling head upon which a chemical container is impaled to permit the liquid chemicals from the pierced container to be dispensed into the mixing tank. The pump fills the tank with a predetermined amount of water or other liquid from an external supply, and supply liquid is also discharged from the pump upwardly through the impaling head to thorougly rinse the container. After the container is rinsed, the liquid chemical mixture is recirculated from the bottom of the tank to the pump, and back into the tank until thorough commingling has taken place. Thereafter, the mixture is dispensed to a spray aircraft or other end use.

Another feature of the present invention resides in the use of the aforementioned pump having its intake connected through a conduit to another external supply of chemical liquid. Thus, it may be appreciated that the pump can draw chemicals from the second supply and discharge same into the mixing tank for recirculation and eventual discharge to an end use.

With the above features, it is possible to achieve the general object of commingling chemicals and water or other liquid in a closed system by recirculating the chemicals through a pump and tank while insuring that chemicals are not released into the atmosphere.

A further object of the present invention is to provide an impaling head which may be used to open relatively small liquid containers and rinse same of liquid residue.

Another object of the present invention is to provide a chemical mixing apparatus which permits selective introduction of liquid chemicals from a source into a mixing tank for mixing with a selected amount of another chemical or water. The mixing occurs through continuously recirculating the liquids.

Still another object of the present invention is to provide an extendible-contractible member which is adaptable for placement in various sized drums so that chemicals may be readily withdrawn. Such member also permits liquid to be discharged downwardly through the member and dispensed through spray jets therein for rinsing and cleaning the barrel or drum.

These and other objects of the present invention will be more readily apparent from a consideration of the following drawings taken together with the desired specification.

BRIEF DESCRIPTION OF THE DRAWINGS

Novel features of the improved chemical pumping system in accordance with the present invention will be more readily understood from a consideration of the following description taken together with the accompanying drawing, in which a preferred embodiment is illustrated with the various parts thereof identified by suitable reference characters in each of the views, and in which.

DETAILED DESCRIPTION OF THE INVENTION

Figure 1:
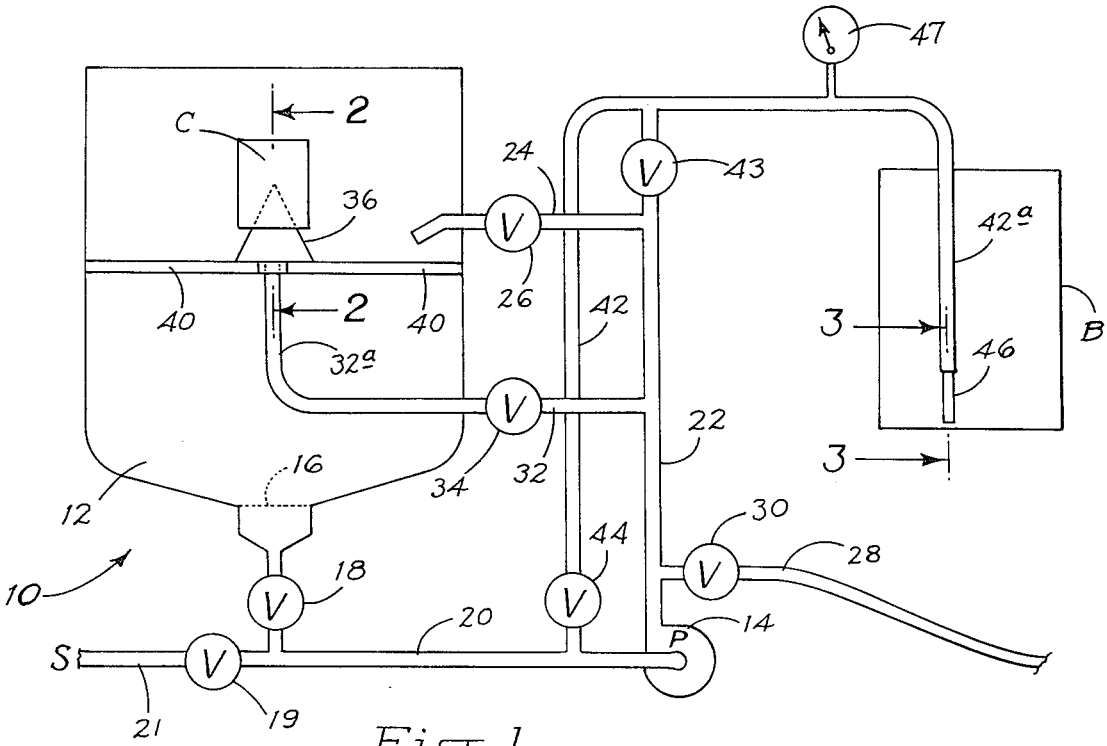
FIG. 1 is a schematic view, partially cut away, illustrating a mixing tank and a pump with associated conduits for mixing liquid from a supply with chemicals from either one of selected containers.

With reference directed initially to FIG. 1 of the drawings, there is shown a chemical pumping and mixing apparatus generally designated at 10. The apparatus 10 includes reservoir means, or a mixing tank 12 which is connected through a plurality of liquid transporting conduits to a circulating pump 14.

The mixing tank 12 includes a drain 16 which is connected through a normally closed valve means 18 to an intake conduit 20 which is connected to the intake side of pump 14. Intake conduit 20 joins with a conduit 21 through a normally closed valve means 19 leading to a first liquid supply S. An outlet conduit 22 extends from the pump 14 and is connected to an infeed conduit 24 which extends into the tank 12. A normally closed valve means 26 is operatively disposed in the infeed conduit 24. A discharge conduit 28 is connected to the outlet conduit 22 and also includes a normally closed valve means 30.

Figure 2:
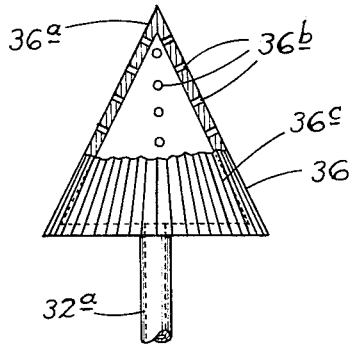
FIG. 2 is an enlarged view taken along lines 2—2 (with the container omitted) and illustrates a partially cut away impaling head used to puncture or pierce chemical containers.

Extending into the tank 12 from the outlet conduit 22 is a conduit 32 which includes a normally closed valve means 34. The conduit 32 includes an upwardly extending leg 32*a* which is connected to an impaling means 36 which includes a head having a pointed portion 36*a.* As shown in FIG. 2, the impaling head 36 is generally cone-shaped, and includes a plurality of apertures 36*b* and flutes or ridges 36*c.* The impaling head 36 and upward extending leg 32*a* of the conduit 32 are rigidly supported within the tank 12 by means of a support arm or arms 40. The support arms 40 are secured to the tank 12 in any convenient manner.

Extending from the pump intake conduit 20 is a second liquid supply conduit 42 having a normally closed valve means 44. The conduit 42 extends from the intake conduit 20 and is situated so that a portion 42*a* may be disposed within a large (30–50 gallon) liquid chemical drum or barrel B. A vertically extendible-contractible member 46 is slidably and sealingly disposed within portion 42*a.*

Figure 3:
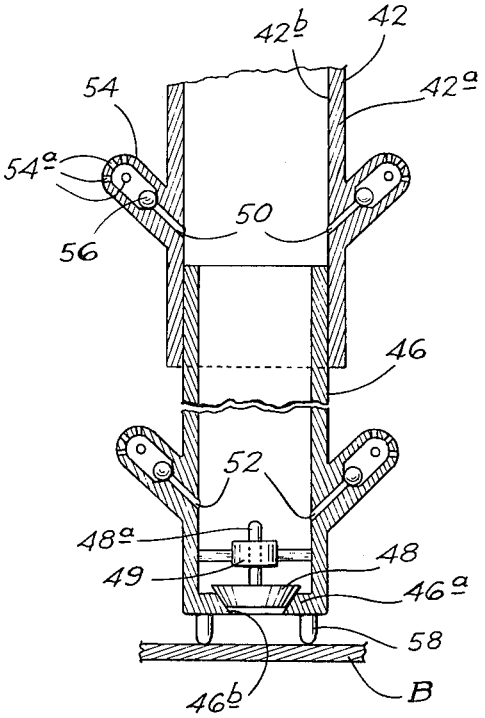
FIG. 3 is an enlarged view taken along lines 3—3 of FIG. 1 and illustrates a cross section of the extendiblecontractible member which is functional to extend to the bottom of a chemical barrel or drum.

From a consideration of FIG. 3, it can be seen that the member 46 is telescopically slidable within the conduit member 42*a* so that an end 46*a* may be disposed adjacent to the bottom of barrel B. The end 46*a* is provided with an aperture 46*b* which receives a pressure-actuated valve 48. The valve 48 may be constructed as a movable plug having a shaft 48*a* slidable in a support guide 44 as shown in FIG. 3, or it may be constructed as a flapper or other type of pressure actuated valve. Extending outwardly from the interior wall 42*b* of conduit member 42*a* are a plurality of upwardly inclined orifices 50. Likewise, the member 46 is provided with a plurality of upwardly extending orifices 52. Each of the orifices 50, 52 extend into a perforated or apertured housing 54 which includes liquid conducting ports 54*a.* Disposed within each of housings 54 is a closure element, or ball, 56. The function of apertures 50, 52 and closing element 56, will be hereinafter more particularly explained. It is to be further noted that abutment legs 58 are situated on the end 46*a* to support such end above the bottom of barrel B.

Additionally it is to be noted that a normally closed valve means 43 interconnects the outlet conduit 22 with the conduit 42. Further, a metering device 47 is provided in the second supply conduit 42 to measure the amount of liquid withdrawn from the barrel B.

OPERATION OF THE MIXING AND PUMPING SYSTEM

When it is desired to mix chemicals from a small container with a liquid, such as water, the apparatus 10 of the present invention is operated as follows. With the afore-mentioned valves all in their normally closed condition, a small container C is impaled upon impaling head 36. The impaling head 36 punctures, or pierces, the container C so that the liquid contents of the container drain into the mixing tank 12. The ridges 36*c* provide channels so that the liquid contents readily drain from container C. The normally closed valve means 19 is then selectively opened along with the valve means 26. The pump 14 is then actuated and liquid, such as water, is transported from the source S through the supply conduit 21, the intake conduit 20 and the outlet and infeed conduits 22, 24, respectively for discharge into the tank 12. After a predetermined amount of water has been transported into the tank 12, the valve means 26 is returned to its normally closed condition, and the normally closed valve means 34 is opened to permit flow of water from the pump 14 upwardly through the conduit 32 and the impaling head 36 for discharge through the apertures 36*b.* Such discharge will result in a spray directed interiorally of the container C so as to thoroughly cleanse and rinse any chemical residue therefrom.

After the rinsing operation, the valve means 19, 34 are selectively returned to their normally closed conditions and valve means 18, 26 are opened so that the chemical and water mixture may be drained through the valve means 18 and transported through the conduits 20, 22 and 24 back into the tank 12. The liquid mixture is continuously recirculated by the pump 14 until the water-chemical mixture is thoroughly commingled. Thereupon, the valve means 18, 26 are returned to their normally closed conditions and the valve means 30 is selectively opened to permit discharge of the mixture through conduit 28. The mixture is pumped to an end use such as an agriculatural spray aircraft.

While the above described system works satisfactorily for relatively small (1–5 gallon) containers such as container C, it is readily appreciated that chemicals may have to be mixed from much larger barrels or drums such as the barrel B as shown in FIG. 1. To this end, the conduit 42 extends into the barrel B and the vertically extendible-contractible member 46 is slidably disposed such that the end 46*a* is situated adjacent the bottom of the barrel B. The slidable member 46 is constructed so that it will extend or contract depending on the size of barrel B. The normally closed valves 44 and 26 are selectively opened, and the pump 14 is actuated. Liquid chemical from the barrel B is the drawn upwardly through the aperture 46*b* so as to displace the valve 48 upwardly thereby permitting liquid to be drawn through the member 46 and upwardly through the conduit 42 for transport through the conduits 22, 24 into the tank 12. The closure elements 56 sealingly engage their respective orifices due to the suction created by the withdrawal of liquid.

The flow meter 47 indicates the amount of liquid chemical withdrawn from the barrel B, and upon a predetermined amount being so withdrawn, the valve 44 is returned to its normally closed condition and the valve 19 is selectively opened. Thereupon, water from the first liquid supply S is pumped through the supply conduit 21, the inlet conduit 20 and the conduits 22, 24 into the tank 12. After a predetermined amount of water has been discharged into the tank 12, the valve 19 is returned to its normally closed condition and the valve means 18 is selectively opened so that the water-chemical mixture may be recirculated through the conduits 20, 22 and 24 in order to thoroughly commingle the liquids. After thorough commingling, the valve means 26 is returned to its normally closed position and the valve means 30 is selectively opened so that the mixture may be channeled to the conduit 28 for discharge therethrough to an end use.

In order to clean the barrel B after the bulk of its liquid contents have been removed, the valve means 19, 43 are selectively opened and water is transported from the souce S by means of the pump 14 through the conduit 42 for discharge through the orifices 50, 52. The water pressure will displace the closure elements 56 away from sealing engagement of the orifices 50, 52 and permit water to be sprayed upwardly and outwardly through the apertures 54*a* in order to clean the inside of the barrel B. The valve 48 is sealingly engaged in its seat to close the orifice 46*b* due to the water pressure. After sufficient rinsing and cleaning has taken place, the valve means 19, 43 are returned to their normally closed conditions and the valve means 44, 30 are opened so that the residue of liquid chemical and cleaning liquid may be transported by means of the pump 14 from the barrel B and the conduit 42 for discharge through the conduit 28. It is to be noted again that when liquid is flowing upwardly through the member 46 and the extension 42*a,* there will be a decrease in pressure which will draw the closure elements inwardly against the outer end of the orifices 50, 52. Also, the valve 48 will be displaced upwardly to permit flow through the aperture 46*b.*

From the above description, it can be readily appreciated that the present invention provides several important advantages. First of all, small containers can be readily impaled so that their contents are directly drained into a mixing tank. The residue of the container is quickly and effectively rinsed from the inside of the container by means of the impaling head providing a rinsing spray. With selective opening of the aforementioned valve, a liquid such as water or other chemical may be readily mixed with the chemical originating from the small impaled container and this mixture may be thoroughly commingled by being recirculated before discharge to an end use. While the present invention provides for mixing in a tank of chemicals from small containers, the invention also enables chemicals from relatively large drums or barrels to be mixed in the same tank. To this end, the present invention contemplates an extendible-contractible member which enabled drums or barrels of different sizes to have their contents readily evacuated. The member is slidable in an outer conduit and is thus vertically adjustable to extent to the bottom of the barrel or drum. Thus, when suction is applied to the conduit and the member, the liquid contents of the barrel or drum will be substantially evacuated.

The amount of liquid withdrawn from the barrel or drum is readily ascertained by means of a flow meter, whereupon such predetermined amount is discharged into the mixing tank for mixing with water or another chemical by means of recirculating with the aforementioned pump. After sufficient commingling, the mixture is ready for discharge to an end use.

While the aforementioned valves have been described as normally closed valves, it is to be appreciated that such valves may be manually or automatically controlled. For instance, a central console can be provided which would automatically and selectively actuate the valves for opening and closing depending upon a particular operation. With such a console, chemicals could be rapidly and accurately intermixed an transported to end uses. Additionally, pollution to the atmosphere would be substantially eliminted due to the face that the system is closed.

Because the containers are thoroughly rinsed, pollution is abated and waste of chemicals is also prevented. While the amount of residue in a small container may be relatively insignificant, it can be readily appreciated that if residue from a large number of small containers was recovered by rinsing the containers, savings of chemical would be considerable. With respect to the larger containers, the savings which would result from a rinsing operation are readily apparent.

While the invention has been particularly shown and described with reference to the foregoing preferred embodiment, it will be understood by those skilled in the art that other changes in form and detail may be made therein without departing from the spirit and scope of the invention as defined in the appended claims. What is claimed is:

1. Apparatus for commingling liquids comprising
reservoir means for receiving and holding liquid;
drain valve means operable for selectively permitting liquid to be withdrawn from said reservoir means;
means disposed adjacent to said reservoir means for impaling a container to permit the container's liquid contents to flow into said reservoir means; and
pump means operable for transporting liquid from an external supply and a supply conduit into said reservoir means, said pump means also being operable for recirculating liquids from said reservoir means through said drain valve means and back into said reservoir means to thereby thoroughly mix the liquids, said pump means being further operable for discharging liquids so mixed away from said reservoir means.

2. The apparatus of claim 1 wherein said pump means includes an intake connected to both said drain valve means and said supply, said pump means further including an outlet to which is connected an infeed conduit and a discharge conduit, said infeed conduit extending toward said reservoir means for recirculating liquids and said discharge conduit extending away from said reservoir means.

3. The apparatus of claim 2, wherein said impaling means includes an impaling head and an associated conduit connected to said outlet, said associated conduit being provided with valve means operable for selectively permitting liquid from the supply to be transported by said pump means to said impaling heading for discharge into an impaled container to thereby rinse the interior of the container.

4. The apparatus of claim 3, wherein said impaling head is provided with a plurality of apertures to permit liquid to be sprayed therefrom.

5. The apparatus of claim 3, wherein said impaling head is substantially rigidly secured adjacent to said reservoir means.

6. The apparatus of claim 3, wherein said impaling head includes a substantially pointed portion and further includes ridges on its outer surface.

7. The apparatus of claim 3 wherein said infeed and discharge conduits are each provided with selectively operable valve means.

8. The apparatus of claim 7, wherein a second supply conduit extends from a second liquid supply to said pump intake, said second supply conduit including valve means selectively operable to permit liquid to be withdrawn from said second supply and transported by said pump means for discharge through said outlet and said infeed conduit into said reservoir means.

9. The apparatus of claim 8, wherein said second supply conduit is also connected to said pump outlet and includes valve means selectively operable to permit passage of liquid from said first supply into said second supply conduit.

10. The apparatus of claim 9, wherein said second supply conduit has an end portion opposite its connection with said pump intake which includes a vertically extendible-contractible member, said member being slidable within a portion of said second conduit and extendible to a position adjacent the bottom of a selected container holding a second liquid supply.

11. The apparatus of claim 10, wherein said member includes abutment means for supporting an end of said member adjacent the bottom of a container, said end also being provided with a valve which permits liquid to be withdrawn upwardly through said member from a second supply but prevents liquid from passing downwardly through said end into the container.

12. The apparatus of claim 11, wherein a portion of said second supply conduit is provided with a plurality of orifices which extend outwardly from the inner wall of said second supply conduit each of the orifices terminating in a perforated housing, a housing including a fluid pressure actuated orifice closure member for sealingly engaging an associated orifice when liquid is being withdrawn from the second liquid supply container and for allowing liquid to pass through said orifices and outwardly into said housing for dispersal therefrom to rinse the container when liquid is transported through said second supply conduit into the container.

13. A method for commingling liquids comprising impaling a container so that liquid flows therefrom into a reservoir;

introducing a predetermined amount of liquid from an external supply into said reservoir;

withdrawing said liquids from said reservoir and reintroducing the same back into said reservoir so that said liquids become mixed; and transporting said mixed liquids away from said reservoir.

14. A method as defined in claim 13, wherein said impaling step further includes simultaneously introducing liquid from said external supply into said container for rinsing same.

* * * * *

UNITED STATES PATENT AND TRADEMARK OFFICE

CERTIFICATE OF CORRECTION

PATENT NO. : 4,045,004

DATED : August 30, 1977

INVENTOR(S) : Henry F. Berger

It is certified that error appears in the above-identified patent and that said Letters Patent are hereby corrected as shown below:

Column 5, line 60, "an" should be —and—,

Column 5, line 62, "elimnted" should be —eliminated—,

Column 5, line 62, "face" should be —fact—,

Column 6, line 41, "heading" should be —head—.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*